US007011256B2

(12) United States Patent
Schorr et al.

(10) Patent No.: US 7,011,256 B2
(45) Date of Patent: Mar. 14, 2006

(54) DEVICE FOR SUPPLYING HIGH PRESSURE FUEL TO AN INTERNAL COMBUSTION ENGINE

(75) Inventors: Harald Schorr, Gerlingen (DE); Alexander Redlich, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 350 days.

(21) Appl. No.: 10/239,081

(22) PCT Filed: Dec. 22, 2001

(86) PCT No.: PCT/DE01/04915

§ 371 (c)(1),
(2), (4) Date: Jan. 13, 2003

(87) PCT Pub. No.: WO02/064969

PCT Pub. Date: Aug. 22, 2002

(65) Prior Publication Data

US 2004/0124286 A1 Jul. 1, 2004

(30) Foreign Application Priority Data

Jan. 19, 2001 (DE) ..... 101 02 234

(51) Int. Cl.
*F02M 59/00* (2006.01)

(52) U.S. Cl. ..... 239/533.2; 239/533.3; 239/533.4; 239/88

(58) Field of Classification Search ..... 239/533.2, 239/533.3, 533.4, 533.9, 533.12, 88, 89, 239/90

See application file for complete search history.

(56) References Cited

U.S. PATENT DOCUMENTS

| | | | | |
|---|---|---|---|---|
| 4,669,659 A | | 6/1987 | Leblanc et al. | |
| 6,053,432 A | * | 4/2000 | Stevens | 239/533.2 |
| 6,189,817 B1 | * | 2/2001 | Lambert | 239/533.2 |
| 6,283,389 B1 | * | 9/2001 | Hofmann | 239/533.11 |
| 6,776,358 B1 | * | 8/2004 | Arimoto | 239/533.3 |

FOREIGN PATENT DOCUMENTS

| | | |
|---|---|---|
| DE | 198 20 264 A1 | 11/1999 |
| EP | 1 041 274 A1 | 10/2000 |

* cited by examiner

*Primary Examiner*—Dinh Q. Nguyen
(74) *Attorney, Agent, or Firm*—Ronald E. Greigg

(57) ABSTRACT

A device for supplying fuel at high pressure to an internal combustion engine, having a pistonlike element which is disposed longitudinally displaceably in a bore of a component. The pistonlike element is guided with a sealing portion in a guide portion of the bore, and the guide portion discharges at one end into a pressure chamber that can be filled with fuel at high pressure and at the other end into a leak fuel chamber. At least one channellike recess is embodied on the sealing portion of the pistonlike element, or the guide portion and this recess communicates hydraulically with the pressure chamber and is sealed off from the leak fuel chamber, except for the annular gap formed between the pistonlike element and the inner wall of the guide portion, and as a result the pistonlike element is hydraulically centered in the bore.

20 Claims, 2 Drawing Sheets

DEVICE FOR SUPPLYING HIGH PRESSURE FUEL TO AN INTERNAL COMBUSTION ENGINE

CROSS-REFERENCE TO RELATED APPLICATIONS

This application is a 35 USC 371 application of PCT/DE 01/04915, filed on Dec. 22, 2001.

BACKGROUND OF THE INVENTION

1. Field of the Invention

The invention is directed to an improved device for supplying fuel at high pressure to an internal combustion engine.

2. Description of the Prior Art

One device of the type with which this invention is concerned, known from German Patent Disclosure DE 198 43 344 A1, is in the form of a fuel injection valve in which a bore is embodied in a valve body, and a pistonlike valve member is disposed longitudinally displaceably in the bore. The valve member has a sealing portion, with which it is guided in a guide portion of the bore, so that in this region, between the valve member and the inner wall of the bore, only an extremely small annular gap remains, which is precisely large enough to assure the longitudinal displaceability of the valve member. On the end of the guide portion of the bore toward the combustion chamber, a pressure chamber embodied by a radial enlargement of the bore adjoins the guide portion; this pressure chamber can be filled with fuel at high pressure. The pressure chamber continues, toward the combustion chamber, in the form of an annular conduit surrounding the valve member, and on the end toward the combustion chamber it is bounded by a valve sealing face that closes off the bore from the combustion chamber. The valve member, on its end toward the combustion chamber, has a valve sealing face, which cooperates with the valve seat to control at least one injection opening, so that the injection opening can be made to communicate with the pressure chamber by means of the longitudinal motion of the valve member.

On its end remote from the combustion chamber, the bore is adjoined by a leak fuel chamber, which is kept constantly at a low pressure level by a suitable leak fuel connection. Since at least during the injection a very high fuel pressure prevails in the pressure chamber, a high pressure difference prevails between the two ends of the guide portion of the bore. As a result, fuel is forced from the pressure chamber into the leak fuel chamber through the annular gap, which remains between the sealing portion of the valve member and the guide portion of the bore because of the longitudinal displaceability. Precisely in fuels of the kind used for self-igniting internal combustion engines, the fuel in this region also serves to lubricate the valve member in the bore. To improve the lubricating properties and simultaneously form the lubricant film, various types of recesses on the sealing portion of the valve member are therefore provided in the aforementioned DE 198 43 344 A1. As examples, annular grooves and indentations of circular cross section are proposed, among others, which are meant to produce a uniform lubricant film and thus lead to low wear of the valve member in the bore. Because of the high pressure difference between the two ends of the guide portion of the bore, a hydraulic transverse force occurs, if the valve member tilts, and this force presses the valve member against the inner wall of the bore. This transverse force results from a pressure drop resulting from the narrowing of the cross section in the throttle gap. In DE 198 43 344 A1, providing the annular grooves is meant to achieve stabilization of the valve member by means of a tangential pressure equalization. However, this method reduces the transverse force only at the location of the annular groove. It does not generate any pressure buildup, however, that could act as a restoring force to stabilize the valve member. As a result, excessively high wear to the valve member in the bore can occur, thus shortening the service life of the fuel injection valve or other device for supplying the engine.

SUMMARY OF THE INVENTION

The device according to the invention for supplying fuel at high pressure to an internal combustion engine has the advantage over the prior art that recesses are embodied on the guide portion of the pistonlike element guided in the bore, which communicate hydraulically with the pressure chamber but do not extend to inside the leak fuel chamber. The recesses are preferably embodied as channels, which lead from the high-pressure region, that is, the pressure chamber, to a certain level of the sealing portion but do not lead as far as the inside of the low-pressure region. In this embodiment, the structure of the recesses not only prevents the pressure drop downstream of the narrowest point in the annular conduit formed between the pistonlike element and the bore, but also builds up a higher pressure, compared to the opposite side. This pressure buildup causes the valve member to experience a force which is oriented away from the inner wall surface of the bore and which thus centers the pistonlike element in the bore again.

In an advantageous embodiment of the subject of the invention, the recesses are distributed uniformly over the circumference of the pistonlike element, so as to cause every region of the circumference of the pistonlike element to communicate with the pressure chamber via a recess.

To prevent the leak fuel flow through the annular gap between the pistonlike element and the bore through the recesses from increasing excessively, the cross section of the recesses must be selected to be quite small. In the device of the invention, a depth of 1 to 50 $\mu$m and preferably 2 to 10 $\mu$m is contemplated. In recesses in the form of channels, the width can vary between 100 and 500 $\mu$m.

The embodiment of the recesses of the invention is especially advantageous if the device is a fuel injection valve and the pistonlike element is a valve member. As a result of the high fuel pressures in such fuel injection valves, of the kind preferably used for self-igniting internal combustion engines, an exact alignment of the valve member in the bore is especially important, in order to assure proper operation throughout the service life.

BRIEF DESCRIPTION OF THE DRAWINGS

Other features and advantages of the invention will become apparent from the description contained below, taken with the drawings, in which.

DESCRIPTION OF THE EXEMPLARY EMBODIMENT

Figure 1:
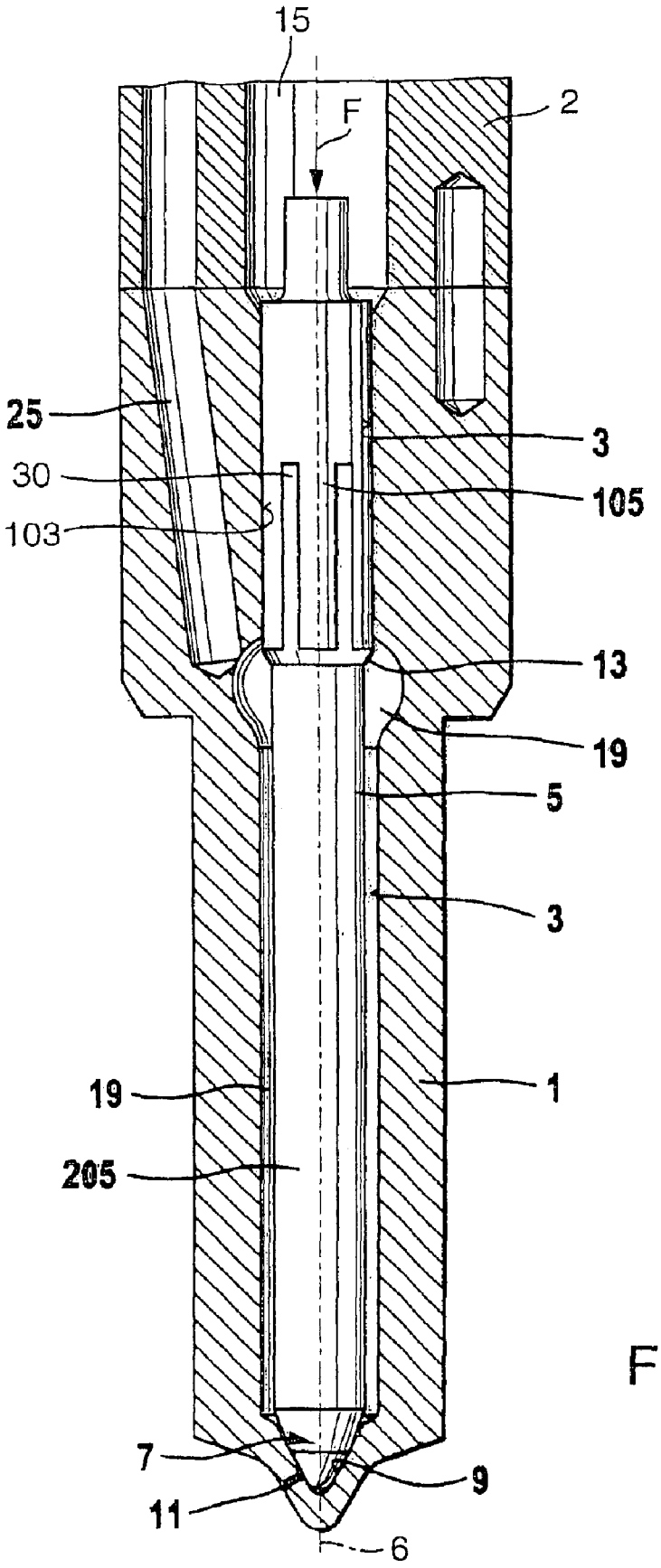
FIG. 1 shows a longitudinal section through a fuel injection valve embodying the invention, and FIGS. 2, 3, 4 and 5 enlargements are fragmentary of the guide region of the valve member of FIG. 1, showing different configurations of the valve member.

In FIG. 1, a longitudinal section is shown through a device for supplying fuel at high pressure to an internal combustion engine; the device here is a fuel injection valve. A component embodied as a valve body 1 has a bore 3, in which a pistonlike element, embodied here as a valve member 5, is disposed longitudinally displaceably. The valve member 5 has a longitudinal axis 6 and is guided sealingly with a sealing portion 105 in a guide portion 103, remote from the combustion chamber, of the bore 3. From the sealing portion 105 of the valve member 5, the valve member 5 tapers toward the combustion chamber, forming a pressure shoulder 13, and there changes over into a valve member shaft 205 of reduced diameter. On the end of the valve member 5 toward the combustion chamber, a valve sealing face 7 is formed, which is embodied at least approximately conically and which cooperates with a valve seat 9 embodied on the end of the bore 3 toward the combustion chamber. At least one injection opening 11 is formed in the valve seat 9 and connects the bore 3 with the combustion chamber of the engine. In the region of the pressure shoulder 13, a radial enlargement of the bore 3 in the valve body 1 forms a pressure chamber 19, which extends in the form of an annular conduit, surrounding the valve member shaft 205, as far as the valve seat 9. The pressure chamber 19 can be made to communicate with a high-pressure fuel source, not shown in the drawing, via an inflow conduit 25 extending within the valve body 1, and it can be filled with fuel at high pressure by way of this source.

The face end, remote from the combustion chamber, of the valve body 1 rests on a valve holding body 2 and is braced axially against it by a tensing device, not shown in the drawing. It can also be provided that the valve body 1 and valve holding body 2 are integral with one another. In the valve holding body 2, a leak fuel chamber 15 is formed, into which the bore 3 discharges and which is continuously pressure-relieved, via a leak fuel conduit not shown in the drawing, so that a low fuel pressure always prevails in the leak fuel chamber 15. A closing device, not shown in the drawing, is disposed in the leak fuel chamber 15 and exerts a closing force F on the valve member 5; the closing force F is aimed at the valve seat 9. The direction of the closing force F is indicated in the drawing by an arrow. The function of the fuel injection valve upon injection of fuel into the combustion chamber of the engine is as follows, and a distinction can be made between two operating modes: In the first operating mode, a high fuel pressure is constantly maintained in the pressure chamber 19 by means of the high-pressure fuel source via the inflow conduit 25. The result is a hydraulic force on the pressure shoulder 13 that is oriented counter to the closing force F. If no injection is to occur, then the closing force F is selected to be high enough that the valve member 5 rests with its valve sealing face 7 on the valve seat 9. If an injection is to occur, then the closing force F is reduced, so that now the hydraulic force on the pressure shoulder 13 predominates, and the valve member 5 is moved in the direction of the leak fuel chamber 15. As a result, the valve sealing face 7 lifts from the valve seat 9, and fuel is injected out of the pressure chamber 19 through the injection opening 11 into the combustion chamber of the engine. By means of a suitable increase in the closing force F, the injection is terminated again, and the valve member 5 returns to its original position by means of a longitudinal motion. In the second operating mode, an at least approximately constant closing force is exerted on the valve member 5, and the motion of the valve member 5 is effected by means of a variable fuel pressure in the pressure chamber 19. If no injection is to occur, a low fuel pressure prevails in the pressure chamber 19, and thus the hydraulic force on the pressure shoulder 13 is less than the closing force F. If an injection is to occur, then fuel is introduced via the inflow conduit 25 into the pressure chamber 19, as a result of which the fuel pressure there rises. As soon as the hydraulic force on the pressure shoulder 13 is higher than the closing force F, the valve member 5 moves in the longitudinal direction and, as in the first operating mode, lifts with its valve sealing face 7 from the valve seat 9, and the injection takes place as described for the first operating mode. The end of the injection is initiated by providing that the fuel supply through the inflow conduit 25 is interrupted, and as a result the fuel pressure in the pressure chamber 19 drops, and thus the hydraulic force on the pressure shoulder 13 drops as well. Dictated by the closing force F, the valve member 5 returns to its outset position and closes the injection opening 11.

Figure 2:
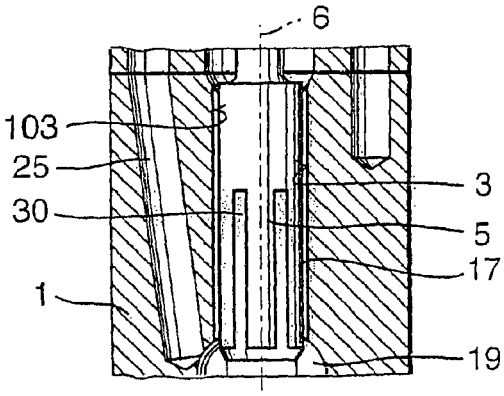

In FIG. 2, an enlarged view is shown in the region of the guide portion 103 of the bore 3. To allow the valve member 5 to be longitudinally displaceable in the bore 3, it must have a certain clearance there, so that between the sealing portion 105 of the valve member 5 and the guide portion 103 of the bore, an annular gap 17 is embodied. Particularly in the first operating mode described above, in which a high fuel pressure is always applied to the pressure chamber 19, fuel flows constantly via this annular gap-like throttle gap from the pressure chamber 19 into the leak fuel chamber 15. In the case of a valve member 5 centered precisely in the center of the bore 3, the fuel pressure in the throttle gap 17 drops virtually linearly from the pressure chamber 19 to the leak fuel chamber 15. The valve member 5 experiences a rotationally symmetrical hydraulic force on the surface of the sealing portion 105, and so the radial forces on the valve member 5 cancel one another out. Conversely, if the valve member 5 is displaced out of its central position, then the annular gap 17 on the side of contact becomes smaller, while on the opposite side it becomes correspondingly larger. If the recesses 30 described below are not taken into account, the pressure in the annular gap 17 drops at least approximately linearly from the high-pressure chamber 19 to the leak fuel chamber 15. However, if the channellike recesses 30, of the kind shown in FIG. 2, are taken into account, the situation is different: The leak fuel flows predominantly past the valve member on the side opposite the contact side of the valve member 5, through the annular gap 17, which is enlarged there. In this region, the channellike recesses 30 play virtually no role in the pressure course in the annular gap 17, 50 that a linear pressure drop continues to pertain here. On the contact side of the valve member 5 on the inner wall of the guide portion 103 of the bore 3, conversely, the annular gap 17 is reduced in size, so that only a slight flow of fuel takes place in this region. Since in this region the recesses 30 communicate hydraulically with the pressure chamber 19, the high fuel pressure of the pressure chamber 19 is propagated into the recesses 30, and so in all the recesses 30, the pressure of the pressure chamber 19 essentially prevails, or at least a markedly higher pressure than at the same level on the opposite side of the annular gap 17. Because of this pressure distribution, there is a resultant force on the valve member 5, which forces the valve member back into the center of the bore 3, and so the valve member 5 remains in a stable equilibrium in the central position in the bore 3.

Figure 3:
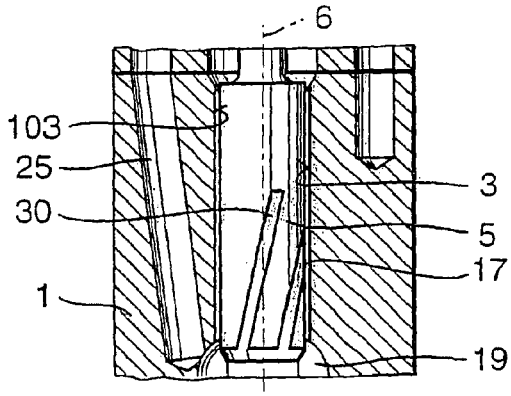
Figure 4:
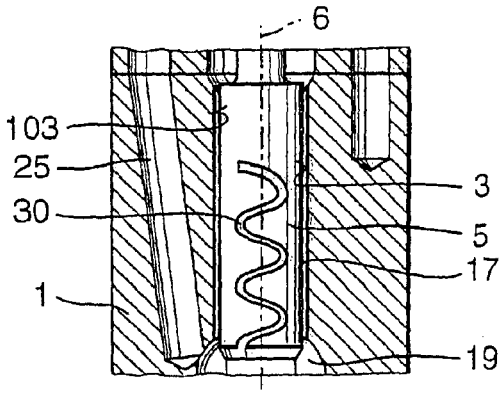
Figure 5:
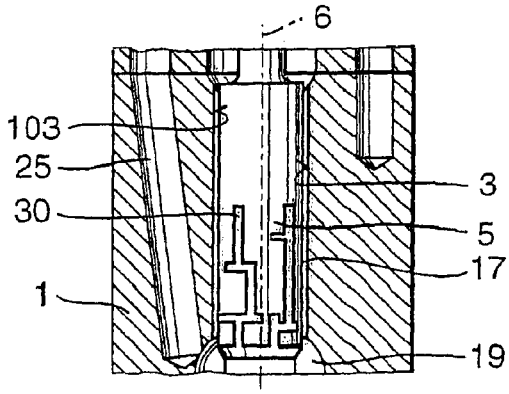

FIG. 3 shows the same detail as FIG. 2 of a further fuel injection valve of the invention. Here, the recesses 30 are embodied as longitudinal channels that are inclined relative to the longitudinal axis 6, so that they have a helical course. A further exemplary embodiment is shown in FIG. 4. Here, the recesses 30 are embodied as meandering channels, which extend over approximately two-thirds of the length of the sealing portion 105 of the valve member 5. In FIG. 5, still another exemplary embodiment is shown, in which the recesses 30 are formed by a pattern intermittently straight channels that communicate with one another hydraulically. This creates labyrinthine structures on the surface of the valve member 5, which assure a uniform distribution of the fuel over the circumference of the valve member 5 without the existence of any preferential direction.

The embodiments of FIGS. 2, 3, 4 and 5 each develop their particular advantage only within the overall geometry of the fuel injection valve. The design, depth and cross-sectional shape that is particularly advantageous in each case must be determined by trial and error or simulation of the flow profile for each individual case.

To prevent the leak fuel flow from the pressure chamber 19 into the leak fuel chamber 15 from assuming excessively high values, the cross section of the recesses 30 must be kept relatively small. To achieve that, the recesses 30 have a depth of from 1 to 50 $\mu$m, preferably 2 to 10 $\mu$m. The width of the channellike recesses 30 is preferably from 100 to 500 $\mu$m, and the cross-sectional shapes of the recesses can for instance be rectangular, circular-segmental, triangular, or U-shaped. Beginning at the end of the sealing portion 105 toward the combustion chamber, the recesses extend over approximately one-half to approximately three-fourths of the length of the sealing portion 105. In this way, the leak fuel flow that flows through the recesses 30 and from there through the annular gap 17 to the inside of the leak fuel chamber 15 is kept within reasonable limits.

Besides the application of the recesses 30 of the invention to a valve member 5, it can also be provided that such recesses are embodied on other pistonlike elements that are guided longitudinally displaceably in a bore, if a high pressure prevails on one side of the bore and low pressure prevails on the other. Such an arrangement exists for instance in the case of fuel injection pumps, which by means of a longitudinally movable piston that is supported in a bore compress fuel on one side and deliver it at high pressure to a fuel injection valve, while on the other side of the guide portion of this piston, a low fuel pressure is maintained.

As an alternative to the devices described above, it can also be provided that the recesses 30 of the invention be embodied not on the pistonlike element 5 but rather on the inner wall of the bore 3. Hydraulically, the result is a situation comparable to the embodiment of the recesses 30 on the outer surface of the pistonlike element 5.

The foregoing relates to preferred exemplary embodiments of the invention, it being understood that other variants and embodiments are possible within the spirit and scope of the invention, the latter being defined by the appended claims.

We claim:

1. In a device for supplying fuel at high pressure to an internal combustion engine, having a pistonlike element (5) which is disposed longitudinally displaceably in a bore (3) of a component (1), and which pistonlike element (5) is guided with a sealing portion (105) in a guide portion (103) of the bore (3), wherein the guide portion (103) discharges at one end into a pressure chamber (19) that can be filled with fuel at high pressure and at the other end into a leak fuel chamber (15), in which leak fuel chamber (15) a low fuel pressure always prevails, the improvement comprising at least one recess (30) on the sealing portion (105) of the pistonlike element (5), which recess communicates hydraulically with the pressure chamber (19) and extends therefrom in a direction toward the leak chamber, and which, except for the annular gap (17) formed between the pistonlike element (5) and the inner wall of the guide portion (103), is sealed off from the leak fuel chamber (15).

2. The device of claim 1, wherein each at least one recess (30) is a longitudinal channel extending generally in the longitudinal direction of the pistonlike element (5), which on its end toward the pressure chamber (19) extend as far as the inside of the pressure chamber (19).

3. The device of claim 2, wherein the recesses extend generally parallel to the pistonlike element.

4. The device of claim 2, wherein the recesses (30) are embodied as channels which extend helically about the guided sealing portion (105) of the pistonlike element (5).

5. The device of claim 2, wherein the recesses (30) are formed by intermittently straight channels which communicate hydraulically with one another.

6. The device of claim 2, wherein the recesses are embodied as meandering channels.

7. The device of claim 2, wherein the channels have a generally rectangular cross section.

8. The device of claim 2, wherein the channels have a triangular cross section.

9. The device of claim 2, wherein the channels have a circular-segmental cross section.

10. The device of claim 1, wherein the recesses (30) extend over from 20% to 80% of the length of the sealing portion (105) of the pistonlike element (5).

11. The device of claim 10, wherein the recesses 30 extends over 50 to 80% of the length of the sealing portion.

12. The device of claim 1, wherein the recesses (30) have a depth of 2 to 50 $\mu$m.

13. The device of claim 12, wherein the recesses (30) have a depth of 2 to 10 $\mu$m.

14. The device of claim 1, wherein a plurality of recesses (30) are embodied, which are distributed uniformly over the circumference of the pistonlike element (5).

15. The device of claim 1, wherein the device is a fuel injection valve.

16. The device of claim 15, wherein the device is a valve body (1).

17. The device of claim 16, wherein the pistonlike element is a valve member (5).

18. In a device for supplying fuel at high pressure to an internal combustion engine, having a pistonlike element (5) which is disposed longitudinally displaceably in a bore (3) of a component (1), and which pistonlike element (5) is guided with a sealing portion (105) in a guide portion (103) of the bore (3), wherein the guide portion (103) discharges at one end into a pressure chamber (19) that can be filled with fuel at high pressure and at the other end into a leak fuel chamber (15), in which leak fuel chamber (15) a low fuel pressure always prevails, the improvement comprising at least one channellike recess (30) formed in the sealing position (105) of the guide portion (103), which at least one recess communicates hydraulically with the pressure chamber (19) and extends therefrom in a direction toward the leak chamber, and which, except for the annular gap (17) formed between the pistonlike element (5) and the inner wall of the guide portion (103), is sealed off from the leak fuel chamber (15).

19. The device of claim 18, wherein each said at least one recess (30) is a longitudinal channel extending generally in the longitudinal direction of the pistonlike element (5), which on its end toward the pressure chamber (19) extend as far as the inside of the pressure chamber (19).

20. The device of claim 18, wherein the channels have a generally rectangular cross section.

* * * * *